US007168497B2

(12) United States Patent
Metcalfe et al.

(10) Patent No.: US 7,168,497 B2
(45) **Date of Patent: *Jan. 30, 2007**

(54) DOWNHOLE SEALING

(75) Inventors: Paul David Metcalfe, Peterculter (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 170 days.

This patent is subject to a terminal disclaimer.

(21) Appl. No.: 10/748,592

(22) Filed: Dec. 30, 2003

(65) Prior Publication Data

US 2004/0149454 A1 Aug. 5, 2004

Related U.S. Application Data

(63) Continuation of application No. 10/145,599, filed on May 14, 2002, now Pat. No. 6,688,400, which is a continuation of application No. 09/470,154, filed on Dec. 22, 1999, now Pat. No. 6,425,444.

(30) Foreign Application Priority Data

| | | |
|---|---|---|
| Dec. 22, 1998 | (GB) | 9828234.6 |
| Jan. 15, 1999 | (GB) | 9900835.1 |
| Oct. 8, 1999 | (GB) | 9923783.6 |
| Oct. 12, 1999 | (GB) | 9923975.8 |
| Oct. 13, 1999 | (GB) | 9924189.5 |

(51) Int. Cl.
*E21B 23/02* (2006.01)

(52) U.S. Cl. ..... 166/380; 166/55.7; 166/207

(58) Field of Classification Search ..... 166/380, 166/384, 55.7, 207
See application file for complete search history.

(56) References Cited

U.S. PATENT DOCUMENTS

| | | | | |
|---|---|---|---|---|
| 761,518 | A | 5/1904 | Lykken | |
| 988,054 | A | 3/1911 | Wiet | |
| 1,301,285 | A | 4/1919 | Leonard | |
| 1,324,303 | A | 12/1919 | Carmichael | |
| 1,339,641 | A * | 5/1920 | Wright | 166/55.7 |
| 1,545,039 | A | 7/1925 | Deavers | |
| 1,561,418 | A | 11/1925 | Duda | |
| 1,569,729 | A | 1/1926 | Duda | |

(Continued)

FOREIGN PATENT DOCUMENTS

| | | |
|---|---|---|
| CA | 2 263240 | 2/1998 |

(Continued)

OTHER PUBLICATIONS

International Preliminary Examination Report, International Application No. PCT/GB99/04365, dated Mar. 23, 2001.

(Continued)

*Primary Examiner*—William Neuder
(74) *Attorney, Agent, or Firm*—Patterson + Sheridan, LLP

(57) ABSTRACT

A method of providing a downhole seal, such as a packer, in a drilled bore between inner tubing and outer tubing comprises: providing an intermediate tubing section defining a seal arrangement for engaging with the inner tubing; and radially plastically deforming the intermediate tubing section downhole to form an annular extension. The extension creates a sealing contact with the outer tubing.

8 Claims, 6 Drawing Sheets

U.S. PATENT DOCUMENTS

| | | | | |
|---|---|---|---|---|
| 1,597,212 | A | 8/1926 | Spengler | |
| 1,880,218 | A | 10/1932 | Simmons | |
| 1,930,825 | A | 10/1933 | Raymond | 153/81 |
| 1,981,525 | A | 11/1934 | Price | 166/4 |
| 2,017,451 | A | 10/1935 | Wickersham | 166/10 |
| 2,214,226 | A | 9/1940 | English | 166/1 |
| 2,216,226 | A | 10/1940 | Bumpous | 36/44 |
| 2,383,214 | A | 8/1945 | Prout | 153/82 |
| 2,424,878 | A | 7/1947 | Crook | 154/82 |
| 2,499,630 | A | 3/1950 | Clark | 153/81 |
| 2,519,116 | A | 8/1950 | Crake | 166/10 |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,754,577 | A | 7/1956 | Maxwell | |
| 2,898,971 | A | 8/1959 | Hempel | 153/82 |
| 3,028,915 | A | 4/1962 | Jennings | 166/46 |
| 3,039,530 | A | 6/1962 | Condra | 166/55 |
| 3,087,546 | A | 4/1963 | Woolley | 166/46 |
| 3,167,122 | A | 1/1965 | Lang | 166/14 |
| 3,179,168 | A | 4/1965 | Vincent | 166/14 |
| 3,186,485 | A | 6/1965 | Owen | 166/63 |
| 3,191,677 | A | 6/1965 | Kinley | 166/14 |
| 3,191,680 | A | 6/1965 | Vincent | 166/46 |
| 3,195,646 | A | 7/1965 | Brown | 166/208 |
| 3,203,451 | A | 8/1965 | Vincent | 138/143 |
| 3,203,483 | A | 8/1965 | Vincent | 166/207 |
| 3,245,471 | A | 4/1966 | Howard | 166/46 |
| 3,297,092 | A | 1/1967 | Jennings | 166/207 |
| 3,326,293 | A | 6/1967 | Skipper | 166/150 |
| 3,353,599 | A | 11/1967 | Swift | 166/15 |
| 3,354,955 | A | 11/1967 | Berry | 166/14 |
| 3,467,180 | A | 9/1969 | Pensotti | 165/180 |
| 3,477,506 | A | 11/1969 | Malone | 166/207 |
| 3,489,220 | A | 1/1970 | Kinley | 166/277 |
| 3,583,200 | A | 6/1971 | Cvijanovic et al. | 72/393 |
| 3,669,190 | A | 6/1972 | Sizer et al. | 166/315 |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers, Jr. et al. | 29/421 |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,382,379 | A | 5/1983 | Kelly | 73/46 |
| 4,387,502 | A | 6/1983 | Dom | 29/568 |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 |
| 4,502,308 | A | 3/1985 | Kelly | 72/58 |
| 4,505,142 | A | 3/1985 | Kelly | 72/54 |
| 4,505,612 | A | 3/1985 | Shelley, Jr. | 405/101 |
| 4,531,581 | A | 7/1985 | Pringle et al. | 166/120 |
| 4,567,631 | A | 2/1986 | Kelly | 29/157.3 |
| 4,581,617 | A | 4/1986 | Yoshimoto et al. | 346/108 |
| 4,588,030 | A | 5/1986 | Blizzard | 166/120 |
| 4,626,129 | A | 12/1986 | Kothmann et al. | 405/43 |
| 4,697,640 | A | 10/1987 | Szarka | 166/120 |
| 4,807,704 | A | 2/1989 | Hsu et al. | 166/313 |
| 4,848,469 | A | 7/1989 | Baugh et al. | 166/382 |
| 4,866,966 | A | 9/1989 | Hagen | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang | 408/22 |
| 5,014,779 | A | 5/1991 | Meling et al. | 166/55.7 |
| 5,052,483 | A | 10/1991 | Hudson | 166/55 |
| 5,052,849 | A | 10/1991 | Zwart | 403/300 |
| 5,156,209 | A | 10/1992 | McHardy | 166/324 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,520,255 | A | 5/1996 | Barr et al. | 175/24 |
| RE35,271 | E * | 6/1996 | Fisk et al. | 405/154 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 176/61 |
| 5,785,120 | A | 7/1998 | Smalley et al. | 166/55 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,021,850 | A | 2/2000 | Wood et al. | 166/380 |
| 6,029,748 | A | 2/2000 | Forsyth et al. | 166/380 |
| 6,070,671 | A * | 6/2000 | Cumming et al. | 166/381 |
| 6,098,717 | A | 8/2000 | Bailey et al. | 166/382 |
| 6,135,208 | A * | 10/2000 | Gano et al. | 166/313 |
| 6,325,148 | B1 | 12/2001 | Trahan et al. | 166/297 |
| 6,425,444 | B1 | 7/2002 | Metcalfe et al. | 166/387 |
| 6,446,323 | B1 | 9/2002 | Metcalfe et al. | 29/523 |
| 6,454,013 | B1 | 9/2002 | Metcalfe | 166/382 |
| 6,457,532 | B1 | 10/2002 | Simpson | 166/380 |
| 6,457,533 | B1 | 10/2002 | Metcalfe | 166/380 |
| 6,527,049 | B2 | 3/2003 | Metcalfe et al. | 166/277 |
| 6,543,552 | B1 | 4/2003 | Metcalfe et al. | 175/57 |
| 6,571,672 | B1 | 6/2003 | Rudd | 83/36 |
| 2001/0040054 | A1 | 11/2001 | Haugen et al. | |
| 2002/0148612 | A1 * | 10/2002 | Cook et al. | 166/313 |
| 2002/0166668 | A1 | 11/2002 | Metcalfe et al. | |
| 2004/0045616 | A1 * | 3/2004 | Cook et al. | 138/98 |

FOREIGN PATENT DOCUMENTS

| | | |
|---|---|---|
| DE | 3213464 | 10/1983 |
| DE | 4133802 | 10/1992 |
| EP | 0 961 007 A2 | 12/1999 |
| GB | 730338 | 5/1955 |
| GB | 792886 | 4/1958 |
| GB | 997721 | 7/1965 |
| GB | 1 277 461 | 6/1972 |
| GB | 1 448 304 | 9/1976 |
| GB | 1 457 843 | 12/1976 |
| GB | 1 582 392 | 1/1981 |
| GB | 2 216 926 A | 10/1989 |

| | | | |
|---|---|---|---|
| GB | 2 320 734 | A | 7/1998 |
| GB | 2 329 918 | A | 4/1999 |
| RU | 2064357 | C1 | 7/1993 |
| RU | 2079633 | C1 | 5/1997 |
| RU | 2144128 | C1 | 10/2000 |
| WO | WO 92/01139 | | 1/1992 |
| WO | WO 93/24728 | | 12/1993 |
| WO | WO 93/25800 | | 12/1993 |
| WO | WO 94/25655 | | 11/1994 |
| WO | WO 97/21901 | | 6/1997 |
| WO | WO 98/00626 | | 1/1998 |
| WO | WO 99/02818 | | 1/1999 |
| WO | WO 99/18328 | | 4/1999 |
| WO | WO 99/23354 | | 5/1999 |
| WO | WO 00/37772 | | 6/2000 |

OTHER PUBLICATIONS

PCT Partial International Search, International Application No. PCT/GB00/04160, dated Feb. 2, 2001.

PCT International Search Report, International Application No. PCT/GB99/04246, dated Mar. 3, 2000.

International Search Report, International Application No. PCT/GB99/04365, dated Mar. 3, 2000.

Hart's International Petroleum Engineer, cover page and pp. 60-63, dated Oct. 1996.

EP Office Action, Application No. 99 962 410.9-2315, dated May 18, 2004.

CA Office Action, Application No. 2,356,131, dated Feb. 2, 2005.

* cited by examiner

DOWNHOLE SEALING

CROSS-REFERENCE TO RELATED APPLICATIONS

This application is a continuation of U.S. patent application Ser. No. 10/145,599, filed on May 14, 2002 now U.S. Pat. No. 6,688,400, which is a continuation of U.S. patent application Ser. No. 09/470,154, filed on Dec. 22, 1999, now U.S. Pat. No. 6,425,444, issued Jul. 30, 2002, which claims benefit of United Kingdom application serial number 9828234.6, filed Dec. 22, 1998, United Kingdom application serial number 9900835.1, filed Jan. 15, 1999; United Kingdom application serial number 9923783.6, filed Oct. 8, 1999, United Kingdom application serial number 9923975.8, filed Oct. 12, 1999, and United Kingdom application serial number 9924189.5, filed Oct. 13, 1999. All of which are herein incorporated by reference in their entirety.

BACKGROUND OF THE INVENTION

1. Field of the Invention

This invention relates to downhole sealing, and to an apparatus and method for use in forming an arrangement to allow creation of a downhole seal. In particular, but not exclusively, the invention relates to the provision of a seal or packer between concentric downhole tubing, such as bore-lining casing and production casing.

2. Description of the Related Art

In the oil and gas exploration and production industry, bores are drilled to access hydrocarbon-bearing rock formations. The drilled bores are lined with steel tubing, known as casing, which is cemented in the bore. Oil and gas are carried from the hydrocarbon-bearing or production formation to the surface through smaller diameter production tubing which is run into the fully-cased bore. Typical production tubing incorporates a number of valves and other devices which are employed, for example, to allow the pressure integrity of the tubing to be tested as it is made up, and to control the flow of fluid through the tubing. Further, to prevent fluid from passing up the annulus between the inner wall of the casing and the outer wall of the production tubing, at least one seal, known as a packer, may be provided between the tubing and the casing. The tubing will normally be axially movable relative to the packer, to accommodate expansion of the tubing due to heating and the like. The packer may be run in separately of the tubing, or in some cases may be run in with the tubing. In any event, the packer is run into the bore in a retracted or non-energised position, and at an appropriate point is energised or "set" to fix the packer in position and to form a seal with the casing. A typical packer will include slips which grip the casing wall and an elastomeric sealing element which is radially deformable to provide a sealing contact with the casing wall and which energises the slips. Accordingly, a conventional packer has a significant thickness, thus reducing the available bore area to accommodate the production tubing. Thus, to accommodate production tubing of a predetermined diameter, it is necessary to provide relatively large diameter casing, and thus a relatively large bore, with the associated increase in costs and drilling time. Further, the presence of an elastomeric element in conventional packers limits their usefulness in high temperature applications.

SUMMARY OF THE INVENTION

It is among the objectives of embodiments of the present invention to provide a means of sealing production tubing relative to casing which obviates the requirement to provide a conventional packer, by providing a relatively compact or "slimline" sealing arrangement which does not require the provision of slips and elastomeric elements to lock the arrangement in the casing.

According to one aspect of the present invention there is provided a method of providing a downhole seal in a drilled bore between inner tubing and outer tubing, the method comprising: providing an intermediate tubing section defining means for sealingly engaging with the inner tubing; and plastically deforming the intermediate tubing section downhole to form an annular extension, said extension creating a sealing contact with the outer tubing.

The invention also relates to a downhole seal as formed by this method.

The invention thus permits the formation of a seal between inner and outer tubing without requiring the provision of a conventional packer or the like externally of the inner tubing. In the preferred embodiment, the intermediate tubing section is of metal and the invention may thus be utilized to create a metal-to-metal seal between the intermediate tubing section and the outer tubing. The sealing means between the intermediate tubing section and the inner tubing may be of any appropriate form, including providing the intermediate tubing section with a polished bore portion and providing the inner tubing with a corresponding outer wall portion defining appropriate sealing bands of elastomer, which permits a degree of relative axial movement therebetween. In other embodiments, the sealing means may be in the form of a fixed location seal. In other aspects of the invention the intermediate tubing may be omitted, that is the inner tubing itself may be deformed to engage the outer tubing.

The outer tubing may be elastically deformed and thus grip the extension, most preferably the deformation resulting from contact with the extension as it is formed. In certain embodiments, the outer tubing may also be subject to plastic deformation. Accordingly, the outer tubing need not be provided with a profile or other arrangement for engagement with the intermediate tubing portion prior to the formation of the coupling.

Preferably, the inner tubing is production tubing, or some other tubing which is run into a drilled bore subsequent to the outer tubing being run into the bore. Preferably also, the outer tubing is bore-lining casing. Accordingly, this embodiment of the invention may be utilized to obviate the need to provide a conventional production packer, as the intermediate tubing section forms a seal with the outer tubing and sealingly receives the inner tubing. This offers numerous advantages, one being that the inner tubing may be of relatively large diameter, there being no requirement to accommodate a conventional packer between the inner and outer tubing; in the preferred embodiments, the intermediate tubing section requires only a thickness of metal at the sealing location with the outer tubing, and does not require the provision of anchoring slips or a mechanism for allowing slips or a resilient element to be energized and maintained in an energized condition. Alternatively, the outer tubing may be of relatively small diameter to accommodate a given diameter of inner tubing, reducing the costs involved in drilling the bore to accommodate the outer tubing.

Preferably, said deformation of the intermediate tubing section is at least partially by compressive yield, most preferably by rolling expansion, that is an expander member is rotated within the tubing section with a face in rolling contact with an internal face of said section to roll the tubing section between the expander member and the tubing section. Such rolling expansion causes compressive plastic deformation of the tubing section and a localised reduction in wall thickness resulting in a subsequent increase in diameter. The expander member may describe the desired inner diameter of the extension, and is preferably urged radially outwardly into contact with the section inner diameter; the expander member may move radially outwardly as the deformation process progresses, progressively reducing the wall thickness of the intermediate tubing section.

Preferably, at the extension, the intermediate tubing section is deformed such that an inner thickness of the tubing section wall is in compression, and an outer thickness of the wall is in tension. This provides a more rigid and robust structure.

At least a degree of deformation of the intermediate section, most preferably a degree of initial deformation, may be achieved by other mechanisms, for example by circumferential yield obtained by pushing or pulling a cone or the like through the intermediate section, or by a combination of compressive and circumferential yield obtained by pushing or pulling a cone provided with inclined rollers or rolling elements.

Preferably, the intermediate tubing section is plastically deformed at a plurality of axially spaced locations to form a plurality of annular extensions.

Preferably, relatively ductile material, typically a ductile metal, is provided between the intermediate tubing section and the outer tubing, and conveniently the material is carried on the outer surface of the intermediate tubing section. Thus, on deformation of the intermediate tubing section the ductile material will tend to flow or deform away from the points of contact between the less ductile material of the intermediate tubing and the outer tubing, creating a relatively large contact area; this will improve the quality of the seal between the sections of tubing. Most preferably, the material is provided in the form of a plurality of axially spaced bands, between areas of the intermediate tubing section which are intended to be subject to greatest deformation. The intermediate tubing section and the outer tubing will typically be formed of steel, while the relatively ductile material may be copper, a lead/tin alloy or another relatively soft metal, or may even be an elastomer.

Preferably, relatively hard material may be provided between the intermediate tubing section and the outer tubing, such that on deformation of the intermediate tubing section the softer material of one or both of the intermediate tubing section and the outer tubing deforms to accommodate the harder material and thus facilitates in securing the coupling against relative axial or rotational movement. Most preferably, the relatively hard material is provided in the form of relatively small individual elements, such as sharps, grit or balls of carbide or some other relatively hard material, although the material may be provided in the form of continuous bands or the like. Most preferably, the relatively hard material is carried in a matrix of relatively ductile material.

Preferably, the method comprises the step of running an expander device into the bore within the intermediate tubing section and energising the expander device to radially deform at least the intermediate tubing section. The expander device is preferably fluid actuated, but may alternatively be mechanically activated. The device may be run into the bore together with the intermediate tubing section or may be run into the bore after the tubing section. Preferably, the device defines a plurality of circumferentially spaced tubing engaging portions, at least one of which is radially extendable, and is rotated to create the annular extension in the tubing section. Most preferably, an initial radial extension of said at least one tubing engaging portion, prior to rotation of the device, creates an initial contact between the intermediate tubing section and the casing which is sufficient to hold the tubing section against rotation.

As noted above, in other aspects of the invention the intermediate tubing section may be omitted, or provided integrally which the inner tubing. For example, the inner tubing may be production tubing and may be deformed to engage surrounding casing. Embodiments of this aspect of the invention may include some or all of the various preferred features of the first-mentioned aspect of the invention, and may be installed using substantially similar apparatus.

Other aspects of the invention relate to locating tubing sections in existing tubing for use in other applications, such as serving an a mounting or support for a downhole device, such as a valve.

According to another aspect of the present invention there is provided apparatus for use in forming a downhole arrangement for permitting sealing between inner tubing and outer tubing utilizing an intermediate tubing section fixed to and in sealing contact with the outer tubing and for sealingly engaging the inner tubing, the apparatus for location within the intermediate tubing section and comprising a body carrying a plurality of circumferentially spaced tubing engaging portions, at least one of the tubing engaging portions being radially extendable to plastically deform the intermediate tubing section, the body being rotatable to form an annular extension in the intermediate tubing section for sealing engagement with the outer tubing.

The invention also relates to the use of such an apparatus to form said downhole arrangement.

Preferably, the apparatus comprises at least three tubing engaging portions.

Preferably, the tubing engaging portions define rolling surfaces, such that following radial extension of said at least one tubing engaging portions the body may be rotated, with the tubing engaging portions in contact with the intermediate tubing section, to create the intermediate tubing section extension. In other embodiments the extension may be created in a step-wise fashion.

Most preferably, the tubing engaging portions are in the form of a radially movable rollers. The rollers may have tapered ends for cooperating with inclined supports. At least one of the supports may be axially movable, such movement inducing radial movement of the rollers. Preferably also, each roller defines a circumferential rib, to provide a small area, high pressure contact surface.

Preferably, said at least one tubing engaging portion is fluid actuated. Most preferably, the tubing engaging portion is coupled to a piston; by providing a relatively large piston area with respect to the area of the portion which comes into contact with the tubing it is possible to produce high pressure forces on the tubing, allowing deformation of relatively thick and less ductile materials, such as the thicknesses and grades of steel conventionally used in downhole tubing and casing. Most preferably, a support for the tubing engaging portion is coupled to a piston, preferably via a bearing or other means which permits relative rotational movement therebetween.

The apparatus may be provided in conjunction with a downhole motor, or the apparatus may be rotated from surface.

The apparatus may further include other tubing expansion arrangements, particularly for achieving initial deformation of the tubing, such as cones, which cones may include inclined rollers.

The apparatus may be provided in combination with an intermediate tubing section.

In other aspects of the invention, the apparatus may be utilized to locate a tubing section for use in other applications, for example as a mounting for a valve or other device, in a bore.

BRIEF DESCRIPTION OF THE DRAWINGS

These and other aspects of the present invention will now be described, by way of example, with reference to the accompanying drawings, in which.

DETAILED DESCRIPTION OF THE PREFERRED EMBODIMENT

Figure 1:
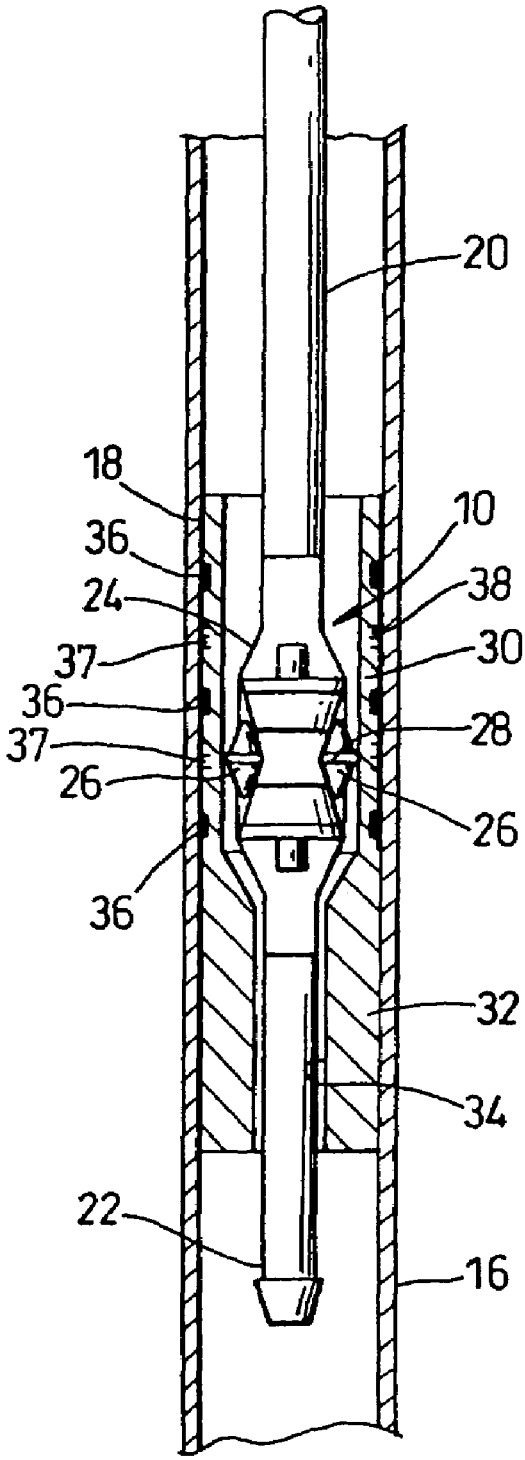
FIGS. 1 to 5 are schematic sectional views of apparatus for use in forming a downhole arrangement for permitting sealing between inner tubing and outer tubing utilizing an intermediate tubing section, and showing stages in the formation of the downhole arrangement, in accordance with a preferred embodiment of the present invention.

Reference is first made to FIG. 1 of the drawings, which illustrated apparatus in the form of an expander device 10 for use in forming a downhole arrangement 12 (FIG. 5) for permitting provision of a seal between inner tubing, in the form of production tubing 11 (FIG. 5), and outer tubing, in the form of bore-lining casing 16, utilising an intermediate tubing section 18. In FIG. 1 the device 10 is illustrated located within the tubing section 18 and is intended to be run into a casing-lined bore, with the section 18, on an appropriate running string 20. A running madrel 22 extends from the lower end of the device 10, and extends from the lower end of the tubing section 18.

The general configuration and operation of the device 10, and the "setting" of the tubing section 18, will be described initially with reference to FIGS. 1 to 5 of the drawings, followed by a more detailed description of the device 10.

The device 10 comprises an elongate body 24 which carries three radially movable rollers 26. The rollers 26 may be urged outwards by application of fluid pressure to the body interior, via the running string 20. Each roller 26 defines a circumferential rib 28 which, as will be described, provides a high pressure contact area. The device 10 is rotatable in the bore, being driven either from surface via the string 20, or by an appropriate downhole motor.

The tubing section 18 comprises an upper relatively thin-walled hanger seal portion 30 and, welded thereto, a thicker walled portion 32 defining a polished bore 34. Once the tubing section 18 has been set in the casing 16, the polished bore 34 allows an appropriate section of the production tubing 11, typically carrying sealing bands, to be located within the bore 34 and form a fluid-tight seal therewith.

The seal portion 30 carries three axially-spaced seal rings or bands 36 of ductile metal. Further, between the bands 36, the seal portion 30 is provided with grip banding 37 in the form of carbide grit 38 held in an appropriate matrix.

To set the tubing section 18 in the casing 16, the device 10 and tubing section 18 are run into the casing-lined bore and located in a pre-selected portion of the casing 16, as shown in FIG. 1. At this point the tubing section 18 may be coupled to the device 10, running mandrel 22 or running string 20, by an appropriate releasable connection, such as a shear ring. The outer diameter of the tubing section 18 and the inner diameter of the casing 16 where the section 18 is to be located are closely matched to provide limited clearance therebetween.

Fluid pressure is then applied to the interior of the device body 24, causing the three rollers 26 to extend radially outwardly into contact with the inner surface of the adjacent area of the seal portion 30. The rollers 26 deform the wall of the seal portion 30 (to a generally triangular form) such that the outer surface of the tubing section 18 comes into contact with the inner surface of the casing 16 at three areas corresponding to the roller locations. Further, the pressure forces created by the rollers 26 may be sufficient to deform the casing 16, thus creating corresponding profiles to accommodate the radial extension of the intermediate tubing section 18. The carbide grit 38 carried by the sealing section 30 is pressed into the softer material of the opposing tubing surfaces, keying the surfaces together.

This initial deformation of the intermediate tubing section 18 is sufficient to hold the tubing section 18 against rotation relative to the casing 16.

Figure 2:
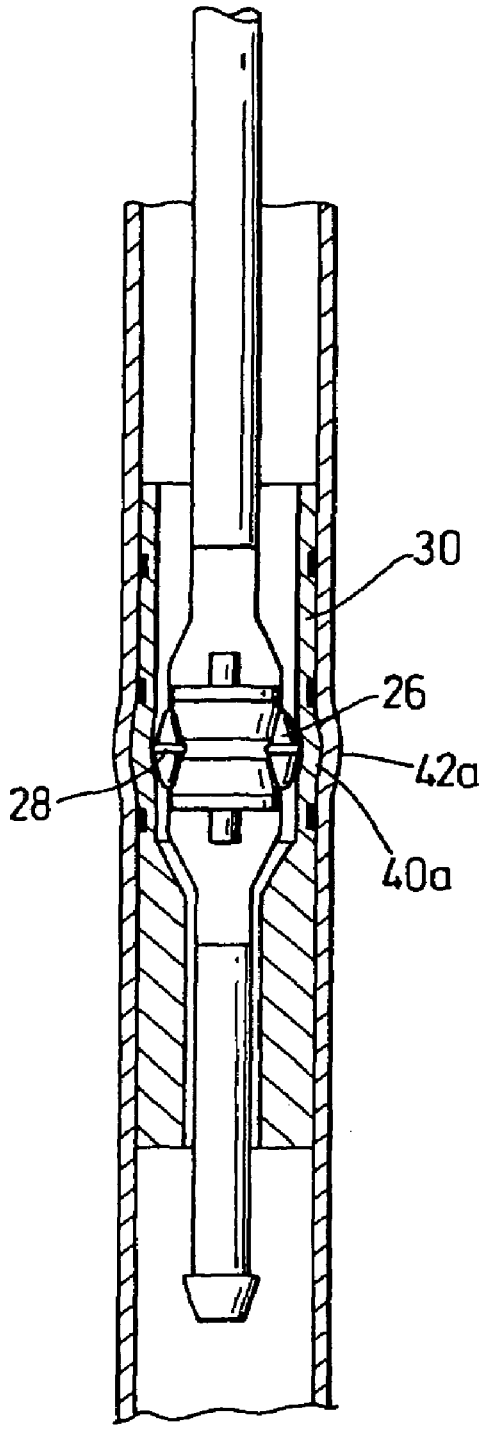

The device 10 is then rotated relative to the tubing section 18 with the rollers 26 in rolling contact with the inner surface of the sealing portion 30, to create an annular extension 40*a* in the sealing portion 30 and a corresponding profile 42*a* in the casing 16, as shown in FIG. 2. The deformation of the sealing portion 30 is by rolling expansion, that is the rollers 26 are rotated within the sealing portion 30 with the ribs 28 in rolling contact with an internal face of the portion 30, with the sealing portion 30 being restrained by the relatively inflexible casing 16. Such rolling expansion causes compressive plastic deformation of the portion 30 and a localised reduction in wall thickness resulting in a subsequent increase in diameter. In the illustrated embodiment this increase in diameter of the sealing portion 30 also deforms the adjacent casing 16, to form the profile 42*a*, by compression.

Figure 3:
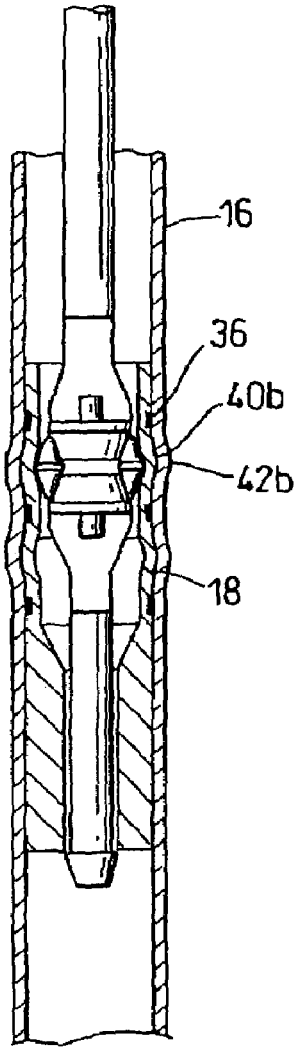

The device 10 is initially located in the intermediate tubing section 18 such that the roller ribs 28 are located adjacent one of the grip bands 37, such that on extension of the rollers 26 and rotation of the device 10, the area of greatest deformation at the extension 40*a* corresponds to the grip band location. Following the creation of the first extension 40*a*, the fluid pressure in communication with the device 10 is bled off, allowing the rollers 26 to retract. The device 10 is then moved axially by a predetermined distance relative to the tubing section 18 before being energized and rotated once more to create a second extension 40*b* and casing profile 42*b*, as shown in FIG. 3. If desired, this process may be repeated to create subsequent extensions. The deformation at the two tubing section extensions 40*a*, 40*b* continues into the seal bands 36, such that the bands 36 are brought into sealing contact with the casing inner surface, between the areas of greatest deformation of the tubing section 18, and flow or deform as the bands 36 and the casing surface are "squeezed" together; this creates fluid tight seal areas at least between the tubing section 18 and the casing 16.

Figure 4:
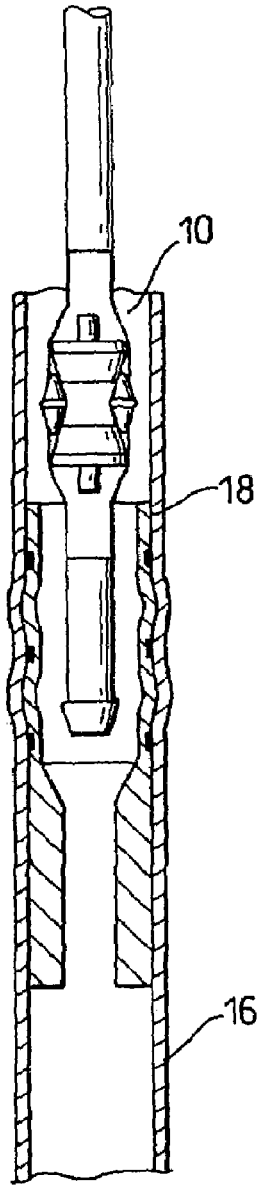

Following creation of the second extension 40*b*, the device 10 is retrieved from the bore, as illustrated in FIG. 4, leaving the deformed tubing section 18 fixed in the casing 16.

Figure 5:
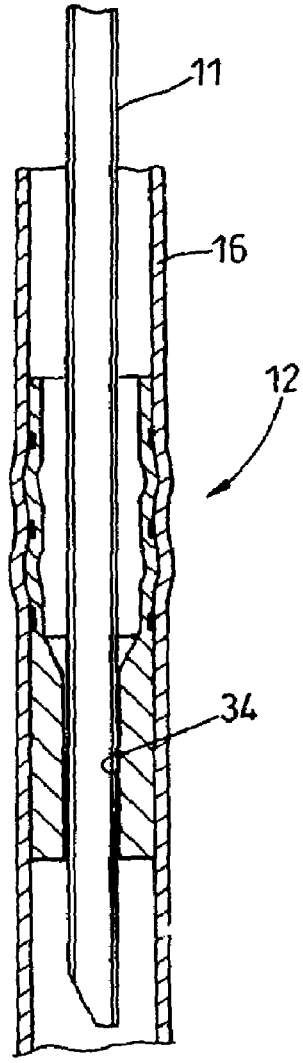

The production tubing 11 is then run into the bore, as shown in FIG. 5, a lower section of the tubing being of corresponding dimensions to the polished bore 34 of the tubing section 18 and provided with appropriate seal bands to provide a seal between the production tubing and the intermediate tubing section 18.

The "set" intermediate tubing section 18 may thus be seen to act in effect as a permanent packer, although the configuration and "setting" procedure for the tubing section 18 is quite different from a conventional packer.

It is apparent that the set tubing section 18 may only be removed by milling or the like, however the absence of large parts of relatively hard materials, such as is used in forming the slips of conventional packers, facilitates removal of the tubing section 18.

Figure 6:
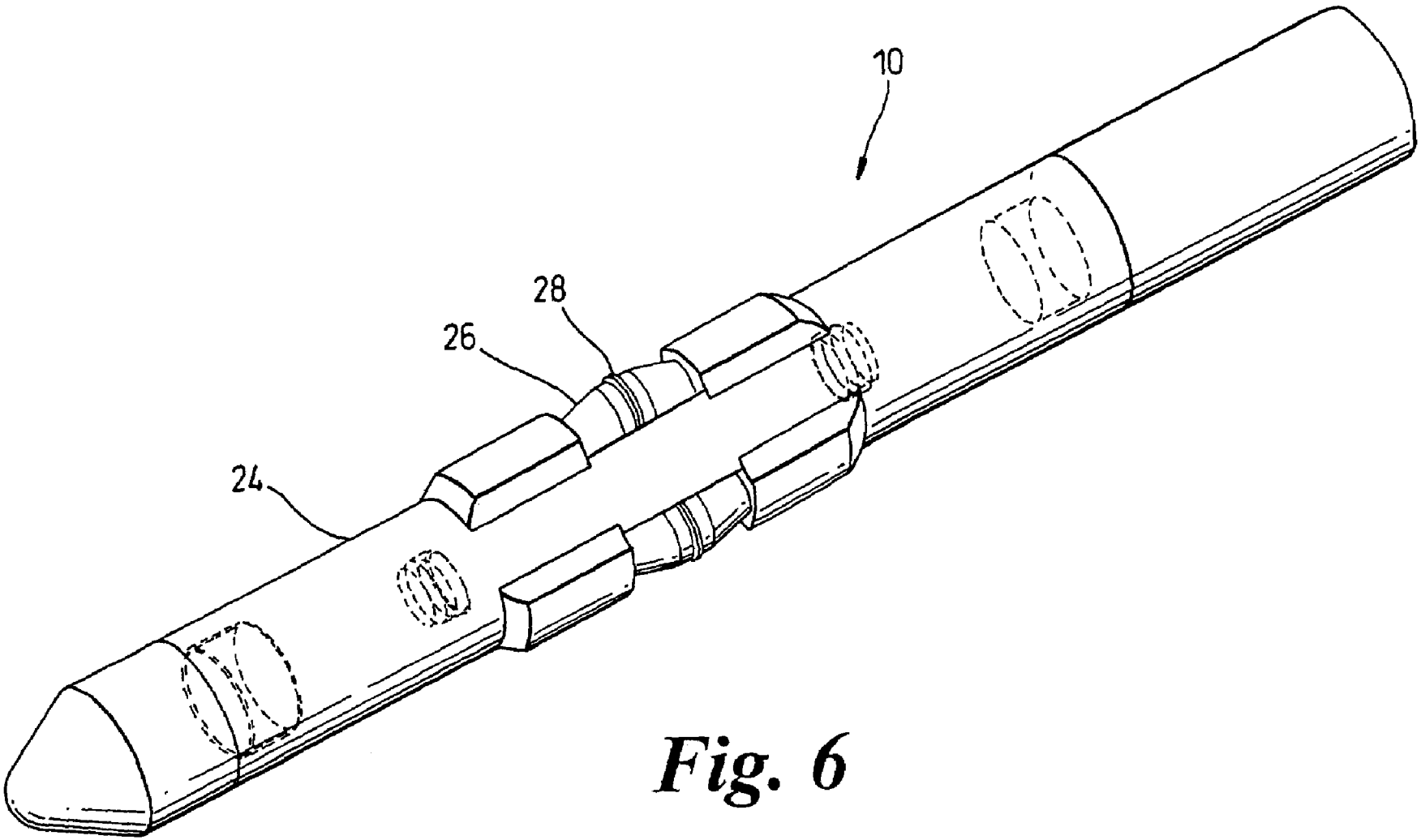
FIG. 6 is an enlarged perspective view of the apparatus of FIG. 1.
Figure 7:
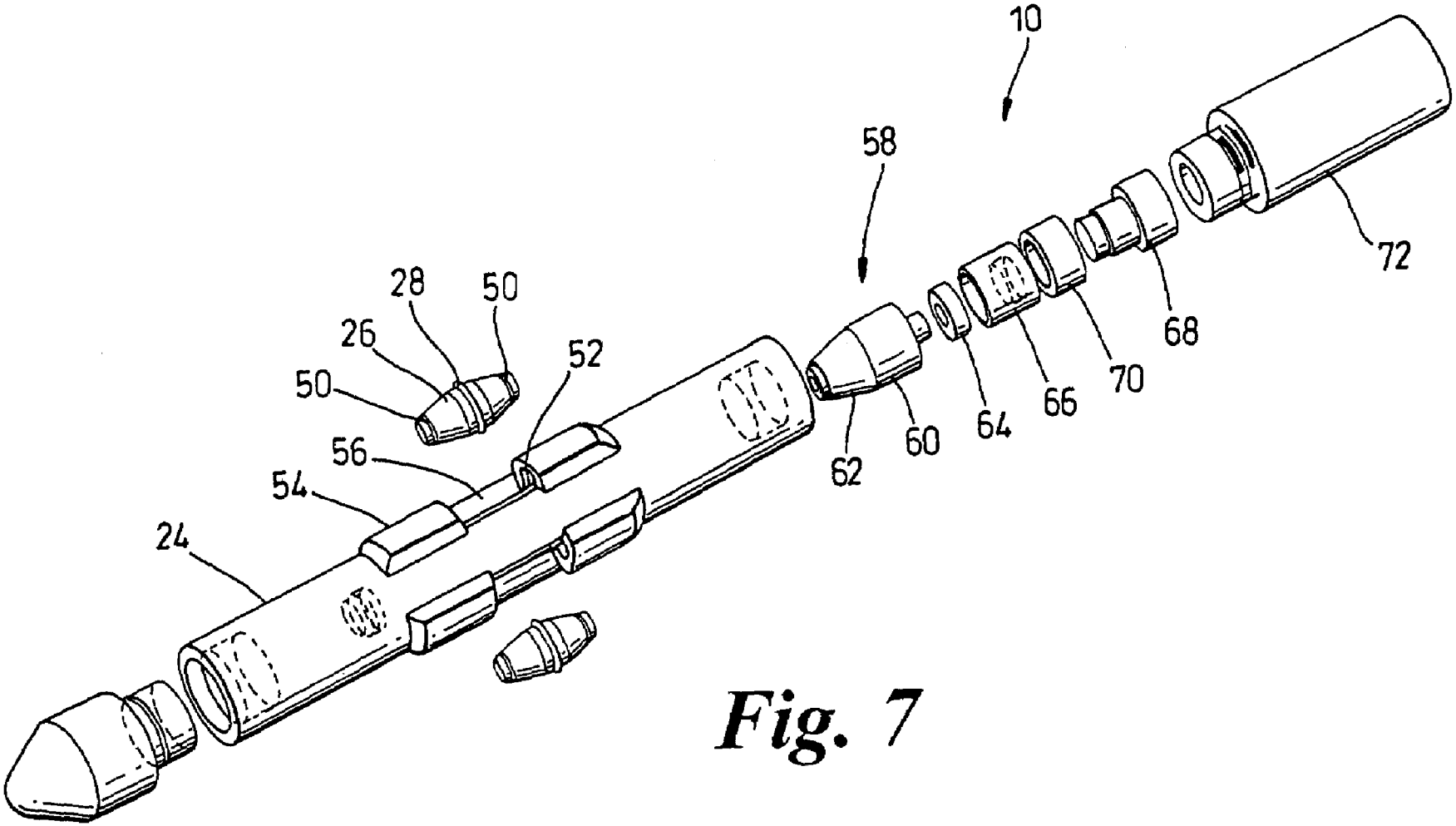
FIG. 7 is an exploded view corresponding to FIG. 6.
Figure 8:
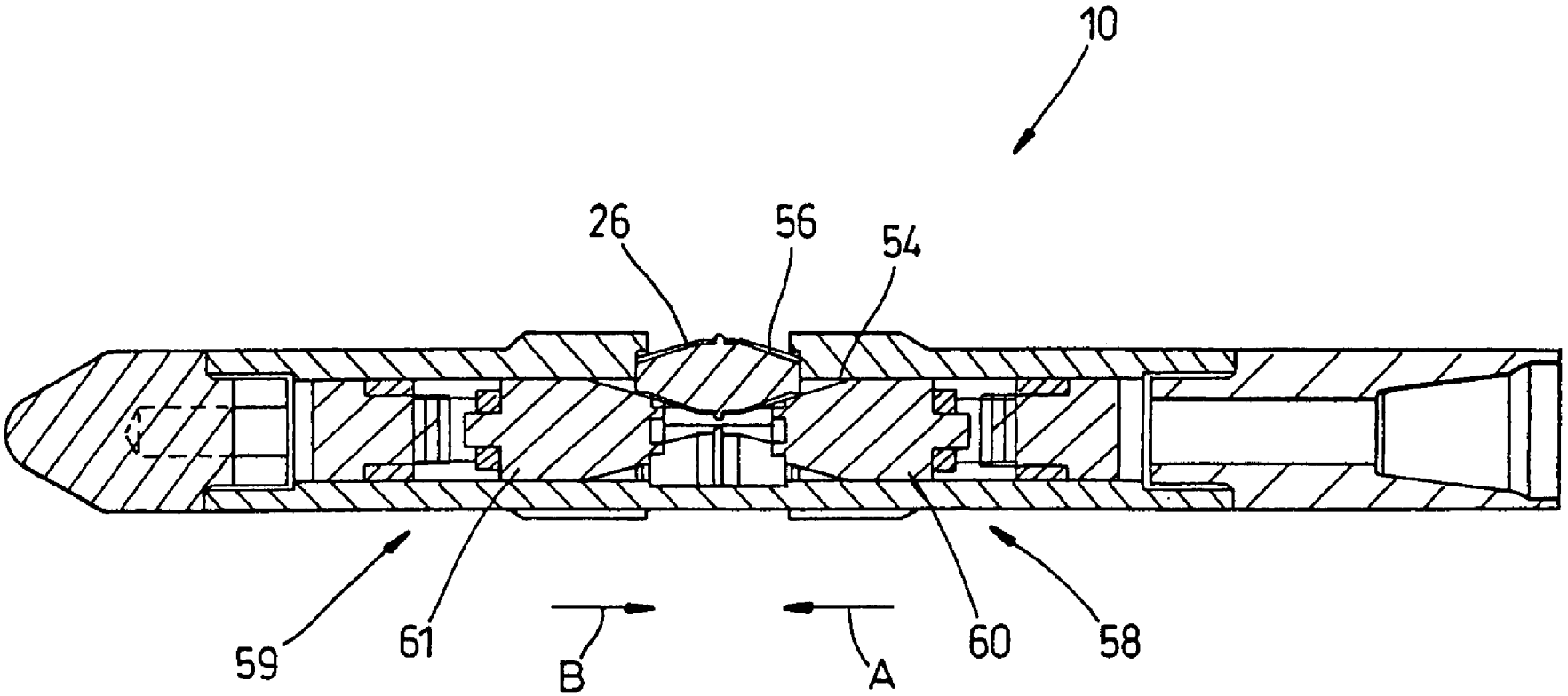
FIG. 8 is a sectional view of the apparatus of FIG. 6.

Reference is now made to FIGS. 6, 7 and 8 of the drawings, which illustrate the device 10 in greater detail. The device body 24 is elongate and generally cylindrical, and as noted above provides mounting for the three rollers 26. The rollers 26 include central portions each defining a rib 28, and taper from the central portion to circular bearing sections 50 which are located in radially extending slots 52 defined in body extensions 54 provided above and below the respective roller-containing apertures 56 in the body 24.

The radial movement of the rollers 26 is controlled by conical roller supports 58, 59 located within the body 24, the supports 58, 59 being movable towards and away from one another to move the rollers radially outwardly and inwardly. The roller supports 58, 59 are of similar construction, and therefore only one support 58 will be described in detail as exemplary of both, with particular reference to FIG. 7 of the drawings. The support 58 features a loading cone 60 having a conical surface 62 which corresponds to the respective conical surface of the roller 26. The cone 60 is mounted on a four point axial load bearing 64 which is accommodated within a bearing housing 66. A piston 68 is coupled to the other end of the bearing housing 66, and has a stepped profile to accommodate a chevron seal 70. The piston 68 is located in the upper end of the body, below a connection between the body 24 and a crossover sub 72.

Accordingly, increasing the fluid pressure in the running string 20 produces an increasing pressure force on the piston 68, which tends to push the loading cone. 60 in the direction A, towards and beneath the roller 26. Similarly, a fluid line leads from the upper end of the body 24 to the area beyond the other roller support 59, such that an increase in fluid pressure tends to urge the other loading cone 61 in the opposite direction. Accordingly, this forces the rollers 26 radially outwardly, and into contact with the inner surface of the intermediate tubing section 18.

This arrangement allows creation of very high pressure forces and, combined with the rolling contact between the roller ribs 28 and the intermediate tubing section 18, and the resulting deformation mechanism, allows deformation of relatively heavy materials, in this case providing deformation of both the tubing section 18 and the surrounding casing 16. Further, the nature of the deformation is such that the deformed wall of the intermediate tubing section 18 features an inner thickness of metal which is in compression, and an outer thickness of metal which is in tension. This creates a rigid and stable structure.

Figure 9:
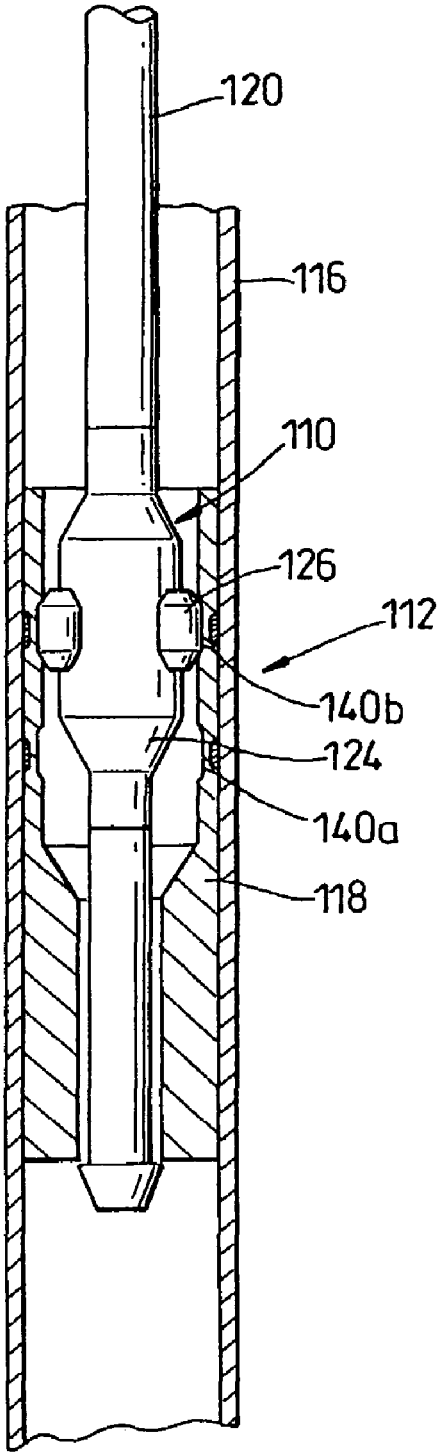
FIGS. 9 and 10 are schematic sectional views of apparatus for use in forming a downhole sealing arrangement in accordance with further embodiments of the present invention.
Figure 10:
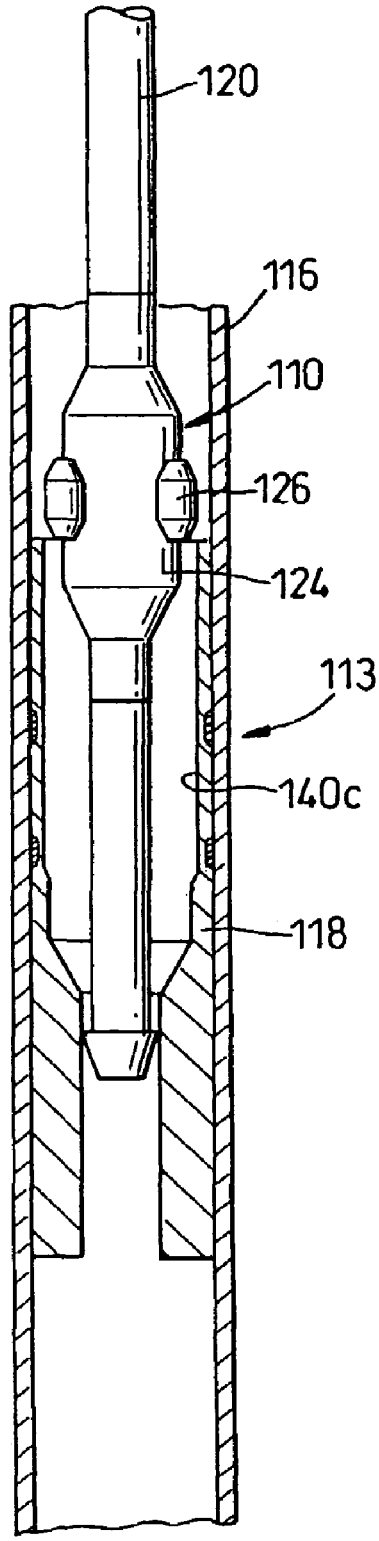

Reference is now made to FIGS. 9 and 10 of the drawings which illustrate an alternative expander device 110 for use in forming downhole arrangements 112, 113 for permitting provision of a seal between inner tubing, in the form of production tubing (not shown), and the outer tubing in the form of bore-lining casing 116, utilising an intermediate tubing section 118. The form of the tubing section 118 is substantially the same as the section 18 described above and in the interest of brevity will not be described in detail again. However, these embodiments of the present invention utilise a different form of expander device 110, as described below.

The device 110 comprises an elongate hollow body 124 which carries three radially movable rollers 126. The rollers 126 may be urged outwards by application of fluid pressure, via the running string 120, to the body interior. The device 110 is rotatable in the bore, being driven either from surface via the string 120, or by an appropriate downhole motor. The rollers 126 are rotatably mounted on relatively large area pistons such that, on application of elevated fluid pressures to the body interior, the 126 rollers are urged radially outwardly into contact with the tubing section 118.

The deformation of the section 118*a* as illustrated in FIG. 9 is carried out in substantially the same manner as the deformation of the section 18 described above, that is by deforming or crimping the tubing section 118 at two locations 140*a*, 140*b*. However, the deformation of the section 118*b* as illustrated in FIG. 10 is achieved by deforming or crimping the section 118 along an extended axial portion 140*c*. This may be achieved in a step-wise fashion, or alternatively by locating the device 110 in the upper end of the section 118, activating the device 110, and then rotating the device 100 and simultaneously applying weight to the device 100 to move the device 100 downwards through the section 118.

It will be clear to those of skill in the art that the above-described embodiments of the invention provide a simple but effective means of allowing the annulus between production tubing and casing to be sealed, using a metal-to-metal seal, the intermediate tubing section acting as a "slimline" replacement for a conventional packer, without requiring the provision of slips and elastomeric seals.

It will also be apparent to those of skill in the art that the above-described embodiments are merely exemplary of the present invention, and that various modifications and improvements may be made thereto without departing from the scope of the invention. For example, the above-described embodiment features an arrangement in which the casing is subject to plastic deformation. In other embodiments, the casing may only be subject to only minor, if any, elastic deformation, sufficient to form a secure coupling between the intermediate tubing section and the casing; where heavy gauge casing is securely in a bore cemented it may not be desirable or even possible to deform the casing to any significant extent. In other aspects of the invention, an intermediate tubing section may be provided for purposes other than creating a seal between inner and outer tubing; the tubing section may provide a sealed mounting for a valve or other device in the outer tubing.

We claim:

1. A method of forming a profile in a section of tubing within a wellbore, comprising:

providing an expander device having at least one radially extendable expander member, wherein the expander member is extended by application of fluid pressure;

positioning the expander device in the wellbore at a predetermined location in the section of tubing; and extending the expander member to deform the tubing at said location to create the profile in an internal face of the tubing.

2. The method of claim 1, wherein the profile is in the form of at least one annular recess.

3. The method of claim 1, wherein the tubing is deformed by rolling expansion, the expander member being rotated within the tubing with a face in rolling contact with the internal face of the tubing.

4. The method of claim 1, wherein the tubing is deformed by compressive plastic deformation, producing a localised reduction in wall thickness and a subsequent increase in tubing diameter.

5. The method of claim 1, wherein the tubing is deformed by compressive plastic deformation, producing flow of wall material to create the profile.

6. The method of claim 1, wherein the expander member is in the form of a roller.

7. The method of claim 1, wherein a plurality of radially extendable expander members are provided.

8. The method of claim 1, wherein the expander member is rotated to create the profile.

* * * * *